US006012322A

United States Patent [19]

Itakura

[11] Patent Number: 6,012,322

[45] Date of Patent: Jan. 11, 2000

[54] SLIDE-DRIVING DEVICE FOR KNUCKLE PRESSES

[75] Inventor: Hideo Itakura, Sagamihara, Japan

[73] Assignee: AIDA Engineering Co., Ltd., Japan

[21] Appl. No.: 09/264,507

[22] Filed: Mar. 8, 1999

[30] Foreign Application Priority Data

Mar. 27, 1998 [JP] Japan ..... 10-100676
Aug. 19, 1998 [JP] Japan ..... 10-249142

[51] Int. Cl.[7] ..... B30B 5/00; B21J 9/18

[52] U.S. Cl. ..... 72/450; 100/285

[58] Field of Search ..... 72/450, 451; 100/280, 100/283, 285, 257

[56] References Cited

U.S. PATENT DOCUMENTS 2,054,428 9/1936 Klocke ..... 100/257
2,882,556 4/1959 Hall ..... 100/257
4,160,409 7/1979 Portmann ..... 100/257
5,317,893 6/1994 Eigenmann ..... 72/450
5,653,141 8/1997 Schonau ..... 100/282

*Primary Examiner*—David Jones
*Attorney, Agent, or Firm*—Morrison Law Firm

[57] ABSTRACT

A slide-driving device for knuckle presses employs a side link affixed at a base end to the knuckle press, and pivoted at its outer end to a junction between links that drive the slide. The side link maintains a very small slope angle for the lower link, which raises and lowers the slide. The small slope angle prevents thrust force from being generated on the slide, and enables performing high-precision molding of products even with extrusion operations, where the molding is started from a position high above the bottom dead center of the slide. In one embodiment of the invention, the base end of the side link is rigidly affixed to the frame of the knuckle press. In a second embodiment of the invention, a bottom dead center compensation device adjusts the position of the outer end of the side link at bottom dead center to compensate for changes in the linkage.

17 Claims, 14 Drawing Sheets

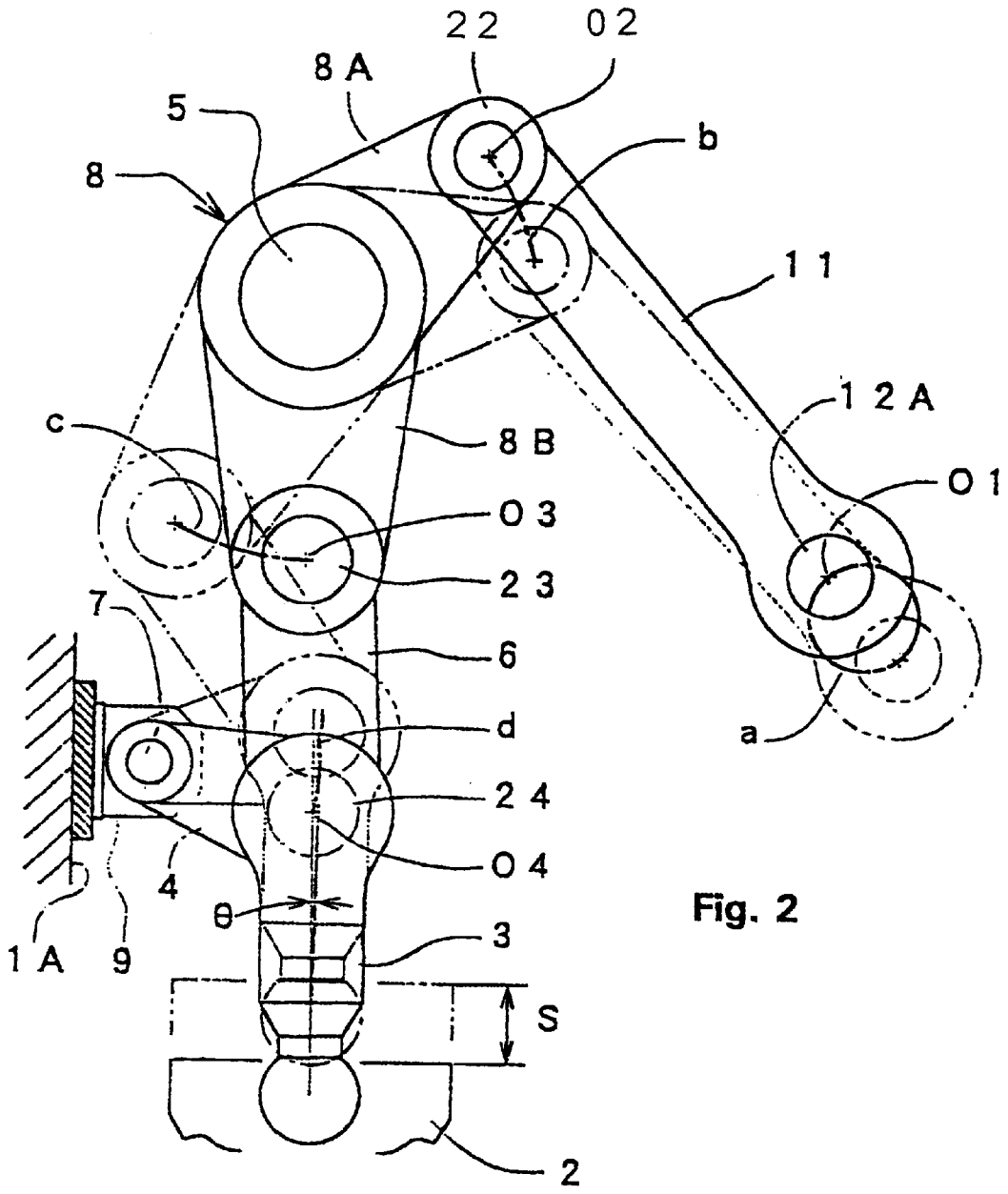
Fig. 2
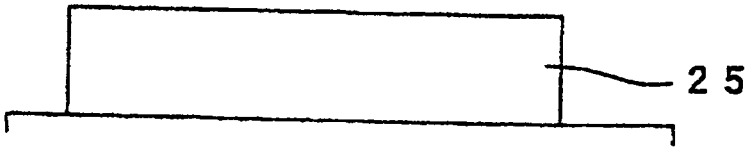

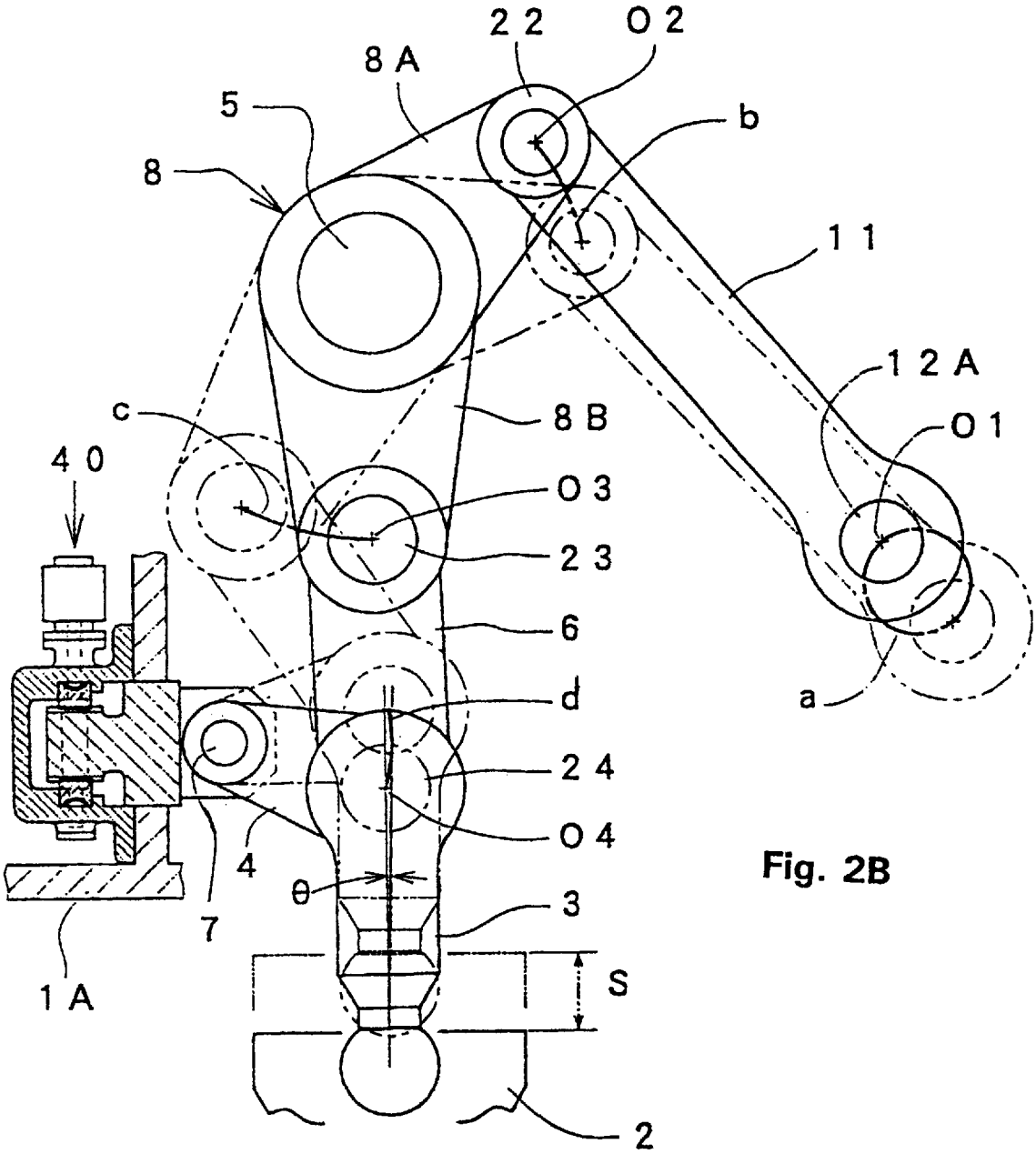
Fig. 2B
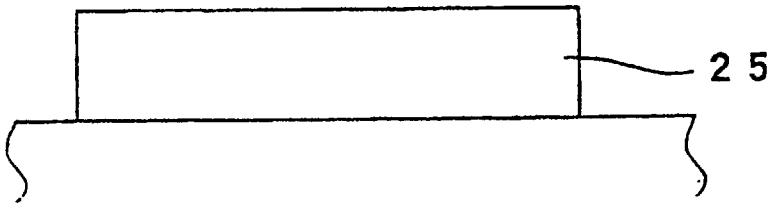

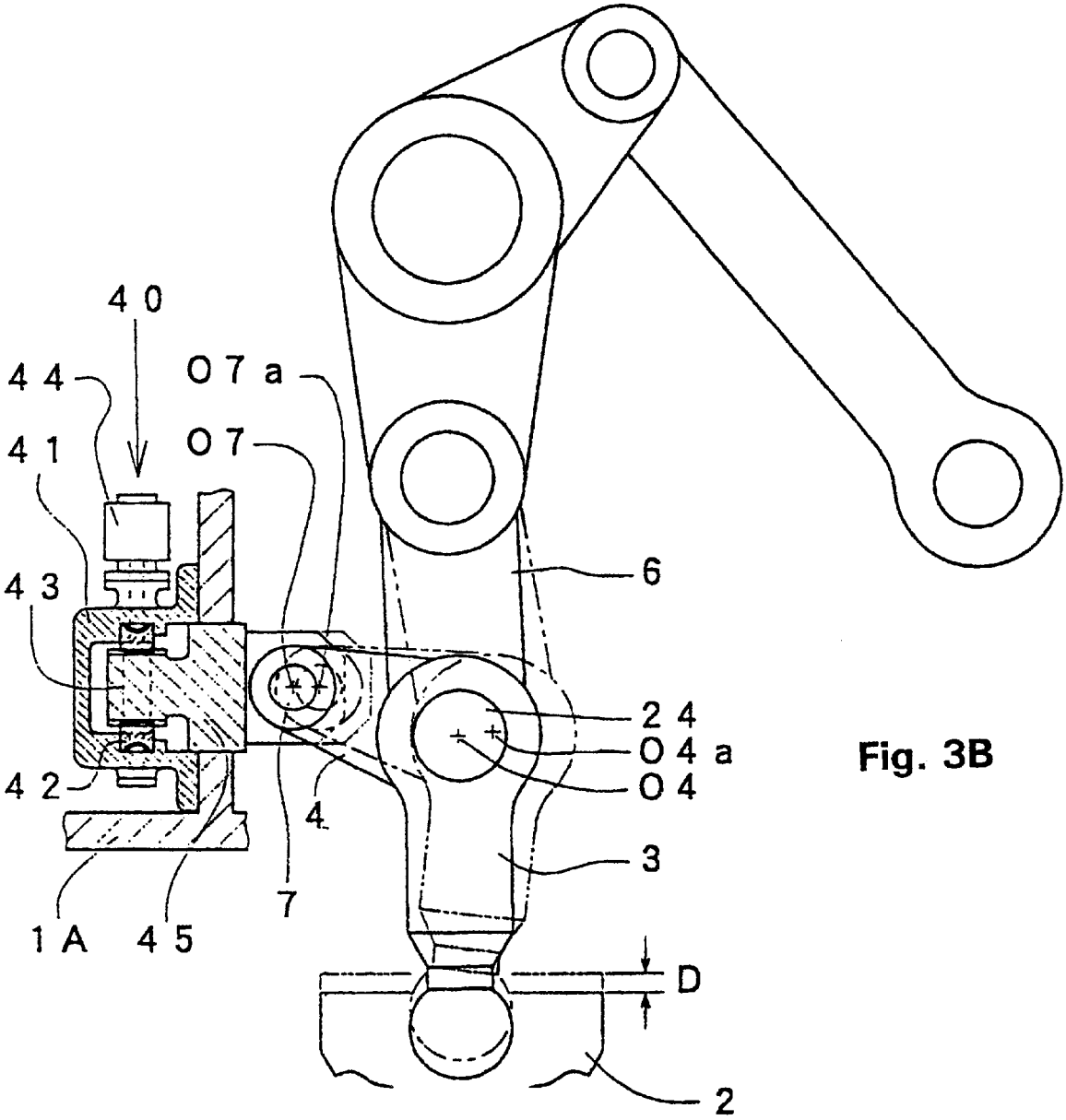
Fig. 3B
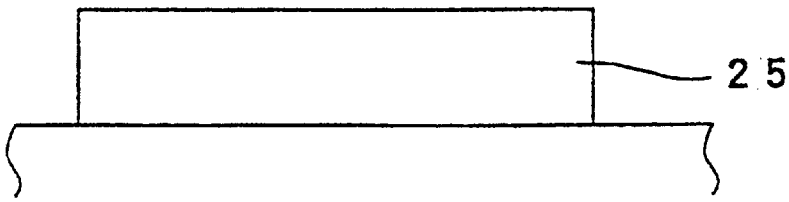

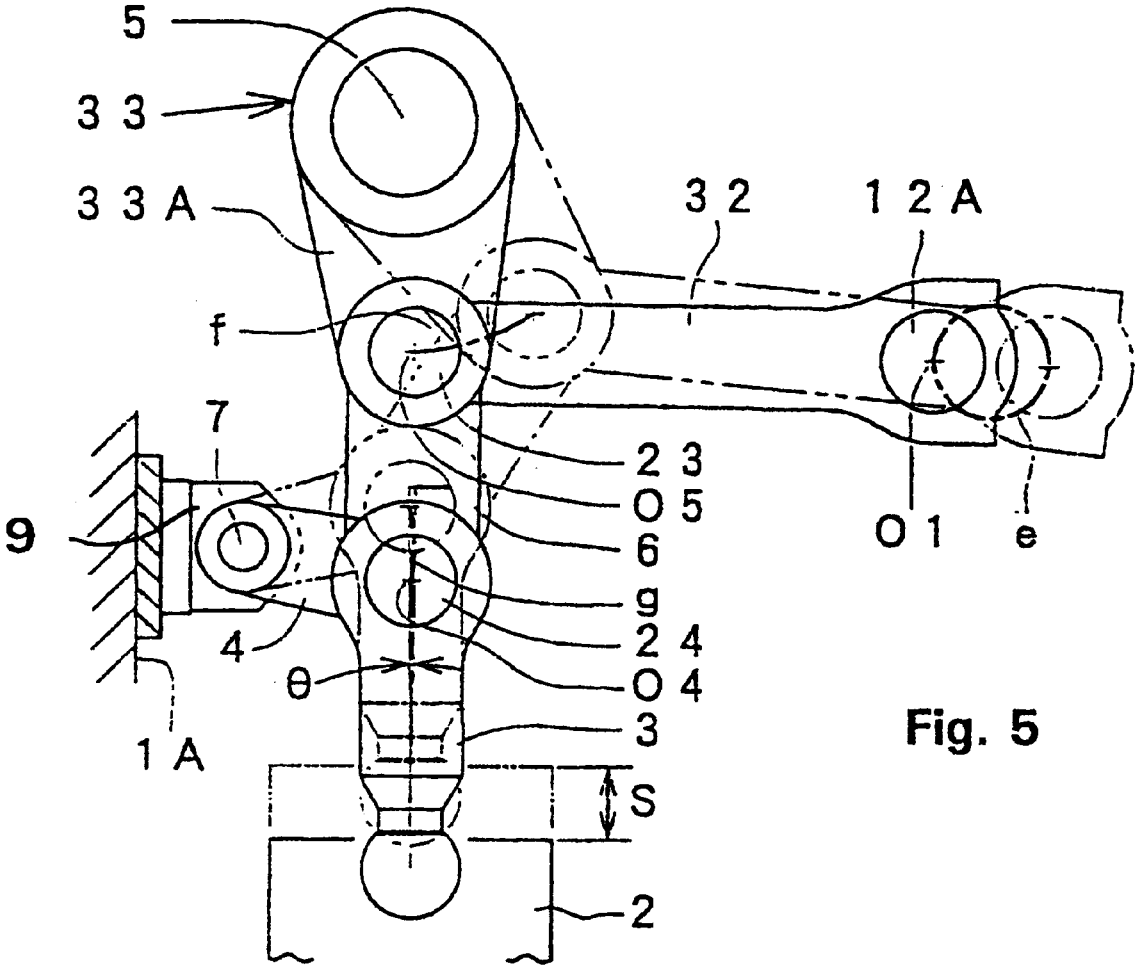
Fig. 5
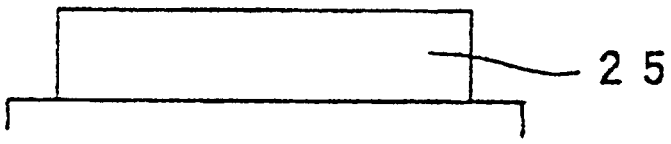

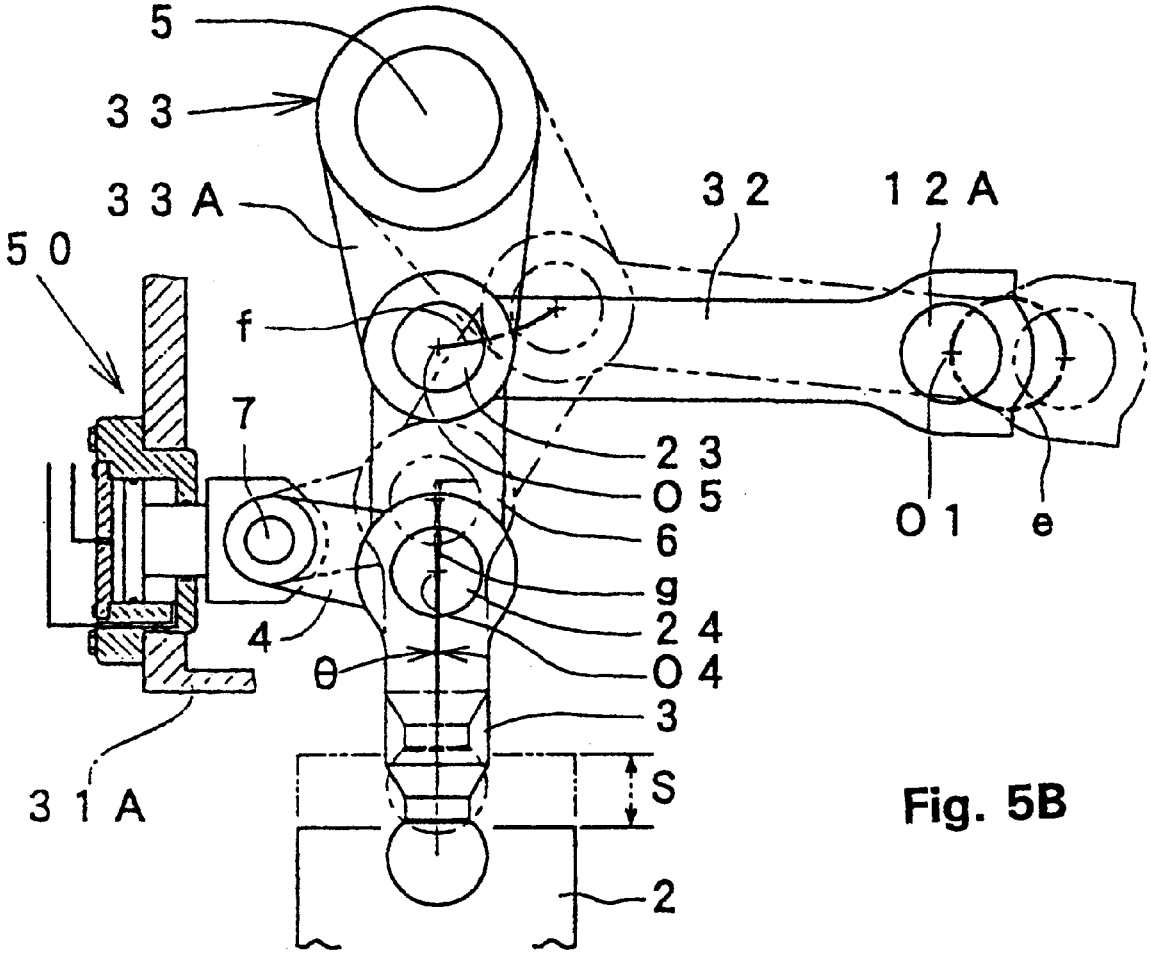
Fig. 5B
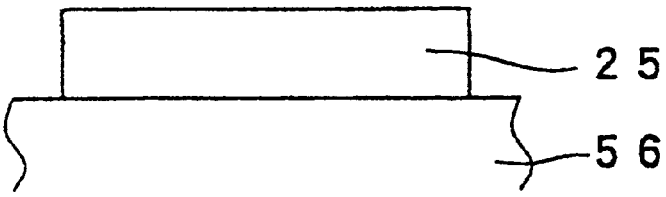

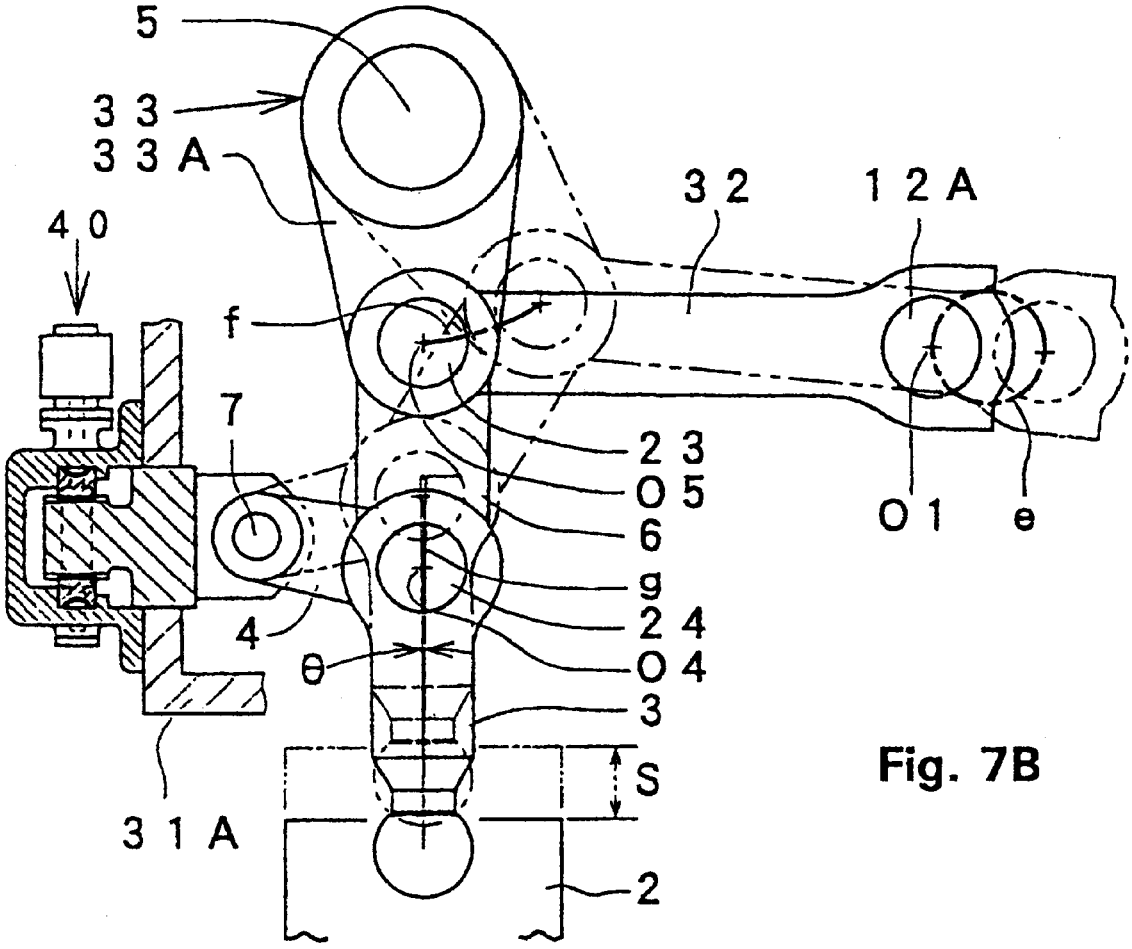
Fig. 7B
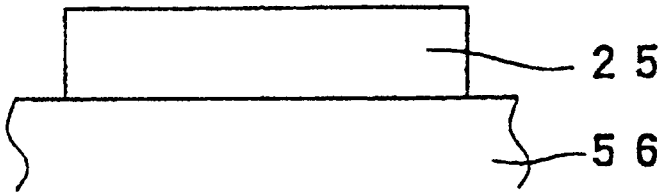

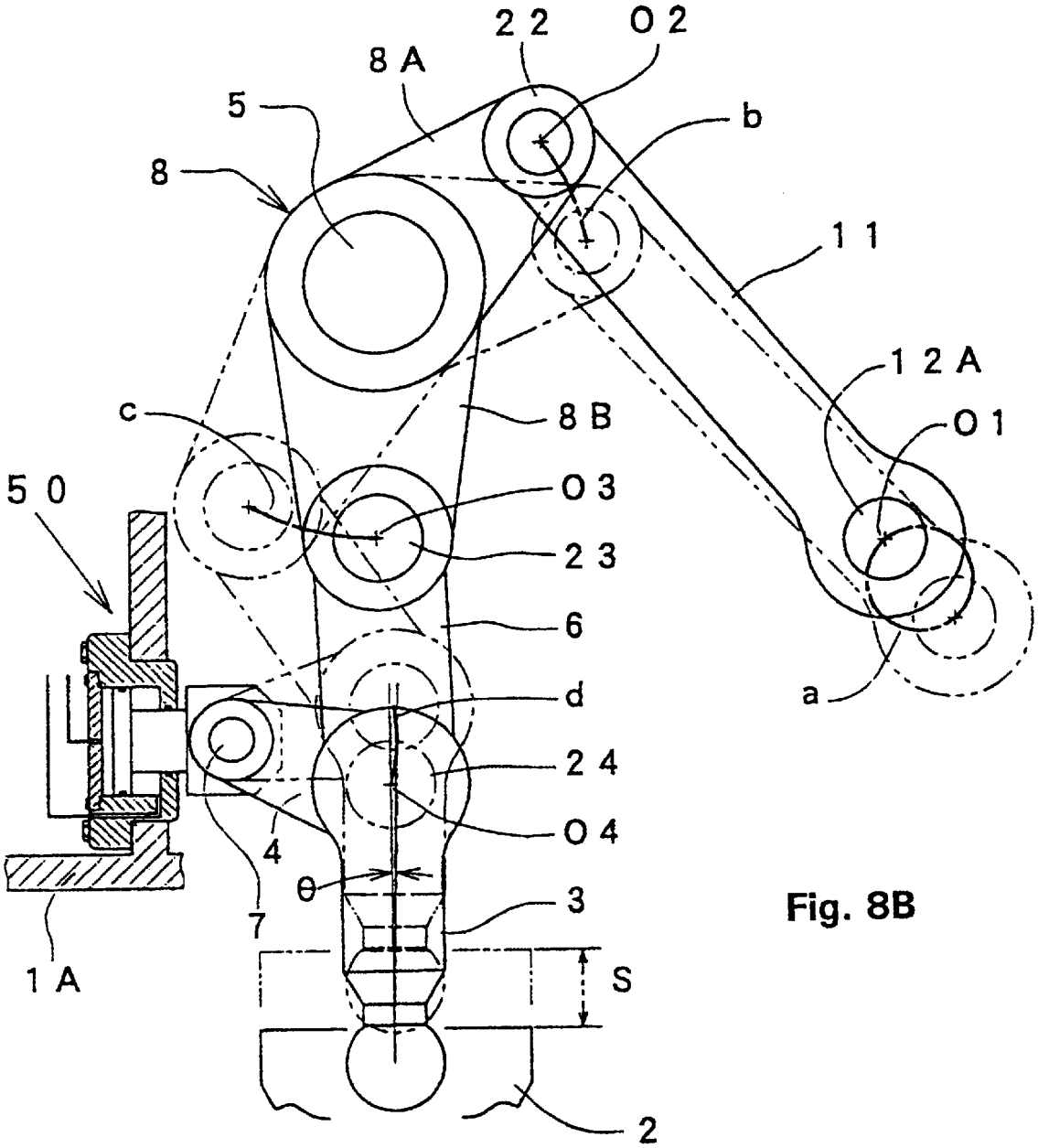
Fig. 8B
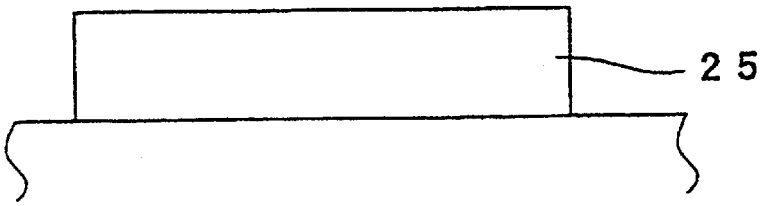

SLIDE-DRIVING DEVICE FOR KNUCKLE PRESSES

BACKGROUND OF THE INVENTION

The present invention relates to a slide-driving device for knuckle presses used primarily in cold forging operations such as sizing and precision extrusion.

Examples of conventional presses used in cold forging include crank presses, link presses, and knuckle presses. Since each of these presses has advantages and disadvantages with regard to molding, these presses are used selectively according to the product to be worked on. In particular, knuckle presses provide a high molding load around the bottom dead center. This has encouraged their use in cold forging.

Japanese laid-open patent publication number 60-24300 presents an example of a slide-driving device for knuckle presses based on conventional technology. Knuckle presses that receive thrust force with a plunger and plunger guide disposed on a frame have also been proposed.

In the slide-driving devices for knuckle presses described above, the lower link, which connects to the slide and raises and lowers the slide, is frequently tilted to a large angle. This makes such knuckle presses inappropriate for extrusion and the like due to the fact that the slide slopes at an angle when thrust force is generated. Also, in knuckle presses that absorb the thrust force with a plunger and a plunger guide, the plunger guide gap becomes larger than the slide guide gap, making this arrangement impractical.

When high-precision is required in the products, fine compensation is required to offset changes in the bottom dead center of the slide, which can be affected by temperature changes in the machine or die. Conventional methods of performing the compensation, by adjusting the bottom dead center of the slide by manually or electronically rotating a nut in a prescribed direction, makes fine adjustments difficult and fails to provide a product with reliably high precision.

OBJECTS AND SUMMARY OF THE INVENTION

The object of the present invention is to provide a slide-driving device for knuckle presses which overcomes the problems described above.

It is a further object of the invention to provide a slide-driving device for knuckle presses that: minimizes the sloping angle of the lower link, which raises and lowers the slide; that prevents thrust force from being generated on the slide; and that can perform high-precision molding of products even in extrusion operations, where molding begins from a high dead-center position of the slide.

It is a further object of the invention to provide a technique for compensating for an offset position of the bottom dead center of the slide without requiring the stopping of the machine.

In order to achieve the objects described above, the present invention provides a slide-driving device for knuckle presses wherein a drive force is generated by a motor and transferred by a flywheel to raise and lower a slide guided by a slide guide. The drive force is transferred via a connecting rod having a base end connected to an eccentric section of a crank shaft meshing with a reduction gear, and a linking member connected to an end of the connecting rod. A bell crank connects the end of the connecting rod to an end of an upper arm via a first connecting pin. The bell crank is also movably connected to a first support pin, which is supported by a frame of the knuckle press. A middle link is connected on one end to an end of a lower arm of the bell crank via a second connecting pin. A lower link has a bottom end movably connected to the slide. A side link has an end connected to both the bottom end of the middle link and the upper end of the lower link via a third connecting pin. The base end of the side link is movably connected, via a second support pin, to a member supported on the frame. In one embodiment, the horizontal positioning of the second support pin is adjustable by a motor, thereby adjusting a slope at the bottom dead center position of the drive.

Alternatively, the present invention provides a slide-driving device for knuckle presses wherein a drive force is generated by a motor and transferred by a flywheel to raise and lower a slide guided by a slide guide. The drive force is transferred via a connecting rod having a base end connected to an eccentric section of a crank shaft meshing with a reduction gear, and a linking member connected to an end of the connecting rod. An upper link is movably supported to a frame of the knuckle press via a first support pin. A middle link is connected, via a connecting pin, to both an end of the connecting rod and an arm of the upper link, or, alternatively, to an end of the connecting rod and another arm disposed on a boss of the upper link. A lower link has a bottom end that is movably connected to the slide. A side link has an end that is connected with both the bottom end of the middle link and the upper end of the lower link via a third connecting pin. The base end of the side link is connected, via a second support pin, to a member supported on the frame. In one embodiment, the member with the second support pin is horizontally movable by a motor to compensate for changes in the bottom dead center position.

Alternatively, the present invention provides a slide-driving device for knuckle presses according to one of the structures described above wherein the slide-driving device is structured so that a maximum slope angle between the lower link and a perpendicular line at a connecting section on the slide connected to the lower link is 3 degrees or less during a cycle of raising and lowering of the slide.

Alternatively, the present invention provides a slide-driving device for knuckle presses according to one of the structures described above wherein the bottom dead center compensation device for the slide includes: a motor attached to the frame of the knuckle case either directly or via a bracket; a screw shaft connected to the motor either directly or via a pulley and a belt; and a female screw member having a female screw section on one end that engages a screw shaft. Rotation of the screw moves the second support pin in a horizontal direction to adjust the bottom dead center of the press.

Alternatively, the present invention provides a slide-driving device for knuckle presses according to one of the structures described above wherein the bottom dead center compensation device for the slide includes a cylinder attached to the frame of the knuckle press either directly or via a bracket. The cylinder has a rod connected to the second support pin either directly or via an intermediate member.

Briefly stated, the present invention provides a slide-driving device for knuckle presses which employs a side link affixed at a base end to the knuckle press, and pivoted at its outer end to a junction between links that drive the slide. The side link maintains a very small slope angle for the lower link, which raises and lowers the slide. The small slope angle prevents thrust force from being generated on the slide, and enables performing high-precision molding of products even with extrusion operations, where the molding is started from a position high above the bottom dead center of the slide. In one embodiment of the invention, the base end of the side link is rigidly affixed to the frame of the knuckle press. In a second embodiment of the invention, a bottom dead center compensation device adjusts the position of the outer end of the side link at bottom dead center to compensate for changes in the linkage.

According to an embodiment of the invention, there is provided a slide-driving device for knuckle presses comprising: a first support pin, the first support pin being affixed to the knuckle press, a bell crank rotatably supported on the first support pin, a drive train for rotating the bell crank about the first support pin, a middle link connected at one of its ends to an end of a lower arm of the bell crank via a second connecting pin, a lower link having a bottom end movably connected to the slide, and a side link having an end connected to both the bottom end of the middle link and the upper end of the lower link via a third connecting pin, and having a base end movably connected, via a second support pin, to a member disposed on the frame.

According to a feature of the invention, there is provided a slide-driving device for knuckle presses comprising: a first support pin rigidly affixed to the knuckle press, an upper link rotatably supported on the first support pin, a middle link pivoted at a first junction with a lower end of the upper link, a connecting rod pivoted at the first junction, a drive train for displacing the connecting rod toward and away from the first junction, a lower link pivoted at a second junction to a lower end of the middle link, a bottom end of the lower link being movably connected to the slide, a side link pivoted at its outer end to the second junction, and a base end of the side link is connected to a member disposed on the frame.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 2 is a side view showing how the structural elements of FIG. 1 cooperate when the slide is at the top dead center and the bottom dead center.

FIG. 2B is a side view showing how the structural elements of FIG. 1B cooperate when the slide is at the top dead center and the bottom dead center.

FIG. 3B is a side view corresponding to FIG. 2, but including a bottom dead center compensation device according to the invention.

FIG. 5 is a figure showing how the structural elements of FIG. 4 cooperate when the slide is at the top dead center and the bottom dead center.

FIG. 5B is a figure showing how the structural elements of FIG. 4B cooperate when the slide is at the top dead center and the bottom dead center.

FIG. 7B is a schematic diagram of structural elements of a knuckle press similar to that of FIG. 5B, wherein the servo linear actuation of the bottom dead center compensation device is replaced with a brake motor actuated bottom dead center compensation device.

FIG. 8B is a schematic diagram of a knuckle press similar to that of FIG. 7B, except that the bottom dead center compensation device 40 is replaced by the bottom dead center compensation device 50 of FIG. 6B.

DETAILED DESCRIPTION OF THE PREFERRED EMBODIMENTS

Figure 1:
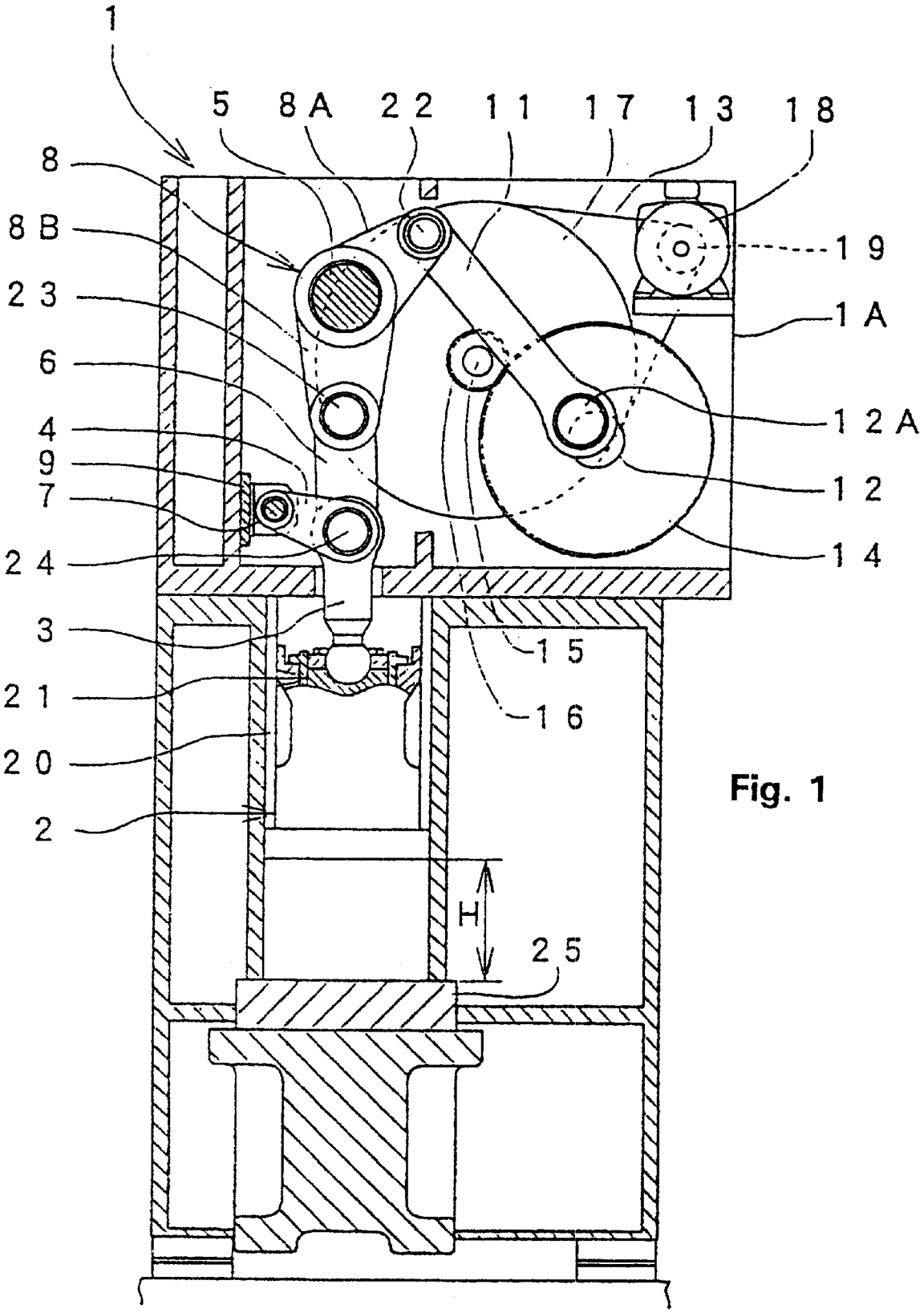
FIG. 1 is a schematic cross-section drawing of a knuckle press according to the first embodiment of the present invention.

Referring to FIG. 1 a main motor 18 is disposed on a frame 1A of a knuckle press 1 to serve as a power source. The drive force from the main motor 18 is transferred to a flywheel 17 disposed on a drive shaft 15 via a pulley 19 and a belt 13. A conventional clutch brake, not shown in the figure, connects and disconnects the flywheel 17 to the drives shaft 15.

A pinion 16 is disposed on the drive shaft 15. Pinion 16 meshes with a drive gear 14 disposed on a crank shaft 12 that is rotatably supported on the frame 1A.

A base section of a connecting rod 11 is connected to an eccentric section 12A of the crank shaft 12.

A first support pin 5 is supported by the frame 1A on an upper portion of the frame 1A. The first support pin 5 is movably connected to a bell crank 8.

An end of an upper arm 8A of the bell crank 8, which is above the first support pin 5, is connected to an end of the connecting rod 11 via a first connecting pin 22. The end of a lower arm 8B of the bell crank 8, which is below the first support pin 5, is connected to an end of a middle link 6 via a second connecting pin 23.

A slide 2 has disposed thereon a single-base slide adjusting device 21 for adjusting a die height H. A lower link 3, which has a ball-shaped lower end, projects downward into the slide adjusting device 21, providing a movable connection.

A bracket 9 is fixed to a lower portion of the frame 1A. A second support pin 7 provides a movable connection with the base end of a side link 4.

The end of the side link 4 is connected to both the bottom of a middle link 6 and the upper end of a lower link 3 via a third connecting pin 24.

With the slide-driving device having the structure described above, the slide 2 guided by a slide guide 20 is raised and lowered according to a prescribed stroke length S.

Figure 1B:
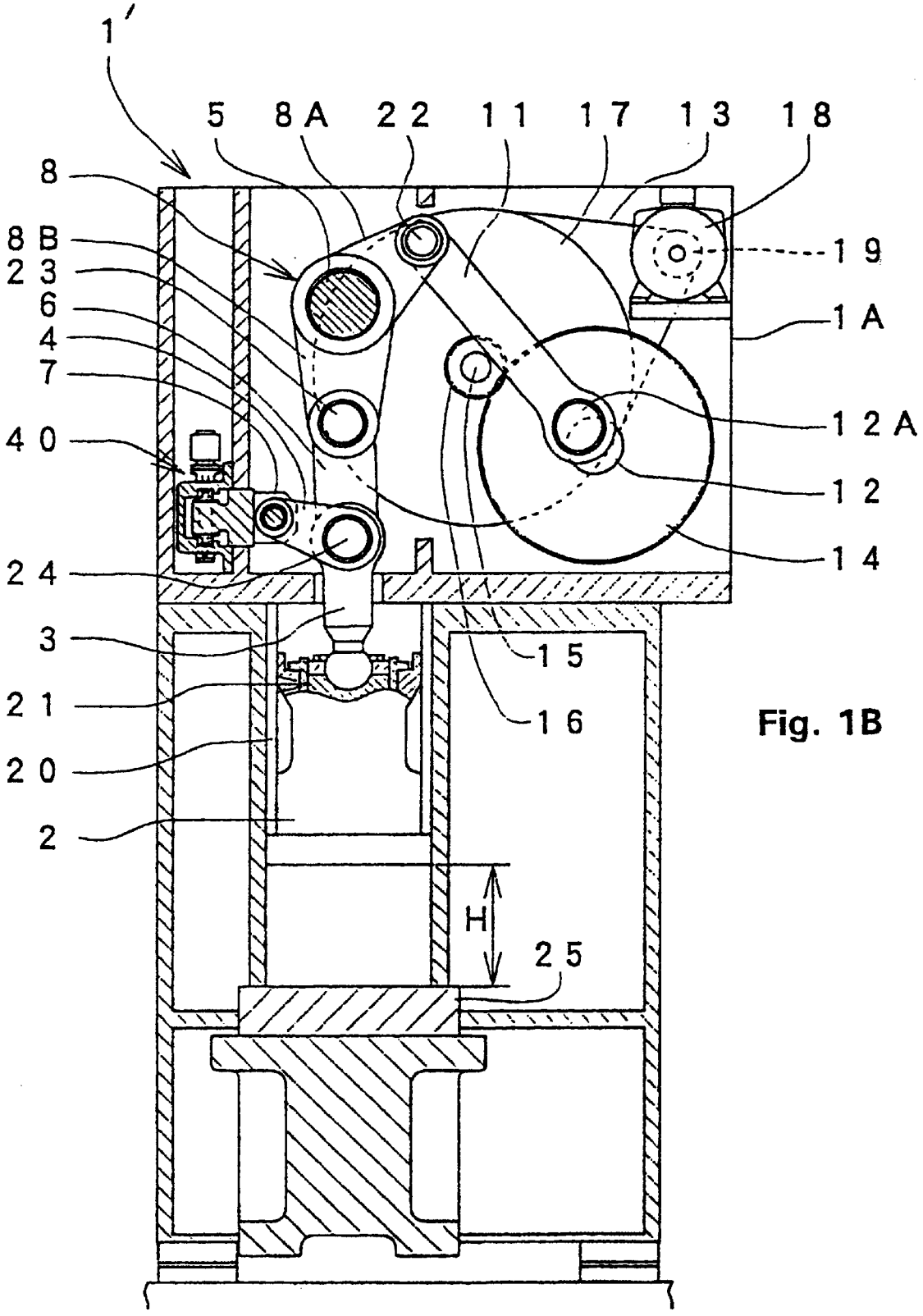
FIG. 1B is a cross-section of a knuckle press similar to the knuckle press of FIG. 1, but including a bottom dead center compensation device.

Referring now to FIG. 1B, a further embodiment of a knuckle press 1' is generally similar to knuckle press 1 of FIG. 1, except for the addition of a bottom dead center compensating device 40. Instead of the fixed location of the second support pin 7 in FIG. 1, the bottom dead center compensating device 40 permits adjustment of the horizontal location of the second support pin 7, whereby the inclination of the lower link 3 when the lower link 3 is at bottom dead center is dynamically controllable.

Referring now to FIG. 2, there are shown, the geometry at top dead center (dot-dash line) and at bottom dead center (solid line) of the slide 2. The structural elements that link the connecting rod 11, which is connected to the eccentric section 12A of the crank shaft 12, and the lower link 3, which is connected to the slide adjusting device 21 of the slide 2 are shown in the two extreme positions.

When the crank shaft 12 is rotated to raise and lower the slide 2 by the prescribed stroke length S, a center O1 of the eccentric section 12A of the crank shaft 12 rotates around a circular path a. A center O2 of the first connecting pin 22, which connects the upper arm 8A of the bell crank 8 and the connecting rod 11, moves along an arcuate path b.

Also, a center O3 of the second connecting pin 23, which connects the lower arm 8B of the bell crank 8 and the middle link 6, moves along an arcuate path c. A center O4 of the third connecting pin 24, which connects the middle link 6 to both the lower link 3 and the side link 4, moves along a slightly arcuate path d.

Thus, the center O4 of the third connecting pin 24 moves along the path d as the lower link 3 moves the slide 2 up and down while maintaining a roughly perpendicular orientation. This provides a stable parallel orientation between a bolster 25 and the slide 2 when the slide 2 is raised and lowered, thus significantly reducing the thrust force acting upon the slide guide 20, which guides the slide 2 when it is raised and lowered.

A maximum slope angle θ, through which the lower link 3 moves during one cycle of raising and lowering the slide 2, is limited to 3 degrees or less to prevent scorching, rapid wear, breakage, and the like, of the slide guide 20. Additionally, high-precision molding can be performed even with extrusion that starts with a high bottom dead center of the slide 2.

The maximum slope angle θ of the lower link 3 can be reduced by making the arm of lower link 3 long, but this would lower the position of the bottom surface of the slide 2 and would require the die height specification to be reduced or the frame height to be increased to maintain the die height. Thus, it would be desirable to make the arm of the side link 4 as long as possible.

Referring now to FIG. 2B, the bottom dead center compensating device 40 is employed to adjust the maximum slope angle θ so that the position of the center O4 of the third connecting pin 24 at bottom dead center is moved to adjust the end points of the arcuate path d to minimize the maximum slope angle θ. The operation of the bottom dead center compensating device 40 is fully detailed later. The remainder of the illustrated portion of FIG. 2B is the same as in FIG. 2, and thus description thereof is omitted.

It is contemplated that the bottom dead center compensating device 40 can be operated during operation of the knuckle press 1, thereby permitting bottom dead center compensation without stopping operation of the knuckle press 1. Alternatively, operation may be limited to times that knuckle press 1 is stopped.

Referring to FIG. 3B, the mechanical structure made up of the lower link 3, the side link 4, the middle link 6, and the slide 2, is illustrated at two adjustment positions of the bottom dead center adjustment device 40. The range of adjustment provided by the bottom dead center compensation device 40 moves the center O7 of the second support pin 7 between the position O7 and the displaced center O7*a*.

The bottom dead center compensation device 40 of the slide includes: a case 41 fixed to the frame 1A of the knuckle press 1. A worm wheel 42 is disposed inside the case 41. A worm shaft 43, driven by a brake motor 44, meshes with the worm wheel 42. A shaft 45 has a screw on one end that engages the worm wheel 42. The shaft 45 is connected at its other end to the second support pin 7.

The worm shaft 43 and the worm wheel 42 are driven by the brake motor 44 to rotate forward and backward, causing the shaft 45 engaged with the worm wheel 42 to be displaced by a prescribed distance horizontally. When the center of the second support pin 7 connected to the shaft 45 moves from point O7 to point O7*a*, the center of the third connecting pin 24 for the lower link 3 and the middle link 6, which are connected to the side link 4, moves from point O4 to point O4*a*. This causes the slide 2 to move upward by an amount D, thus providing fine compensation for the bottom dead center.

Feedback control is performed on the brake motor 44 through a rotary encoder (not shown in the figure) attached to the worm shaft 43, which measures the rotation angle of the motor shaft.

In this embodiment, a brake motor is used as the drive source, but other drive sources such as, for example, a servo motor, a stepping motor, a geared motor, a linear motor, or a hydraulic cylinder may be used.

A further embodiment of the present invention, which is not shown in the figures, involves substituting the bottom dead center compensation device 40 from the prior embodiment with: a motor attached to the frame 1A of the knuckle press 1 either directly or via a bracket; a screw shaft connected to the motor either directly or via a pulley or a belt; and a female screw member having a first end with a female screw that engages the screw shaft and a second end connected to the second support pin 7.

Figure 3:
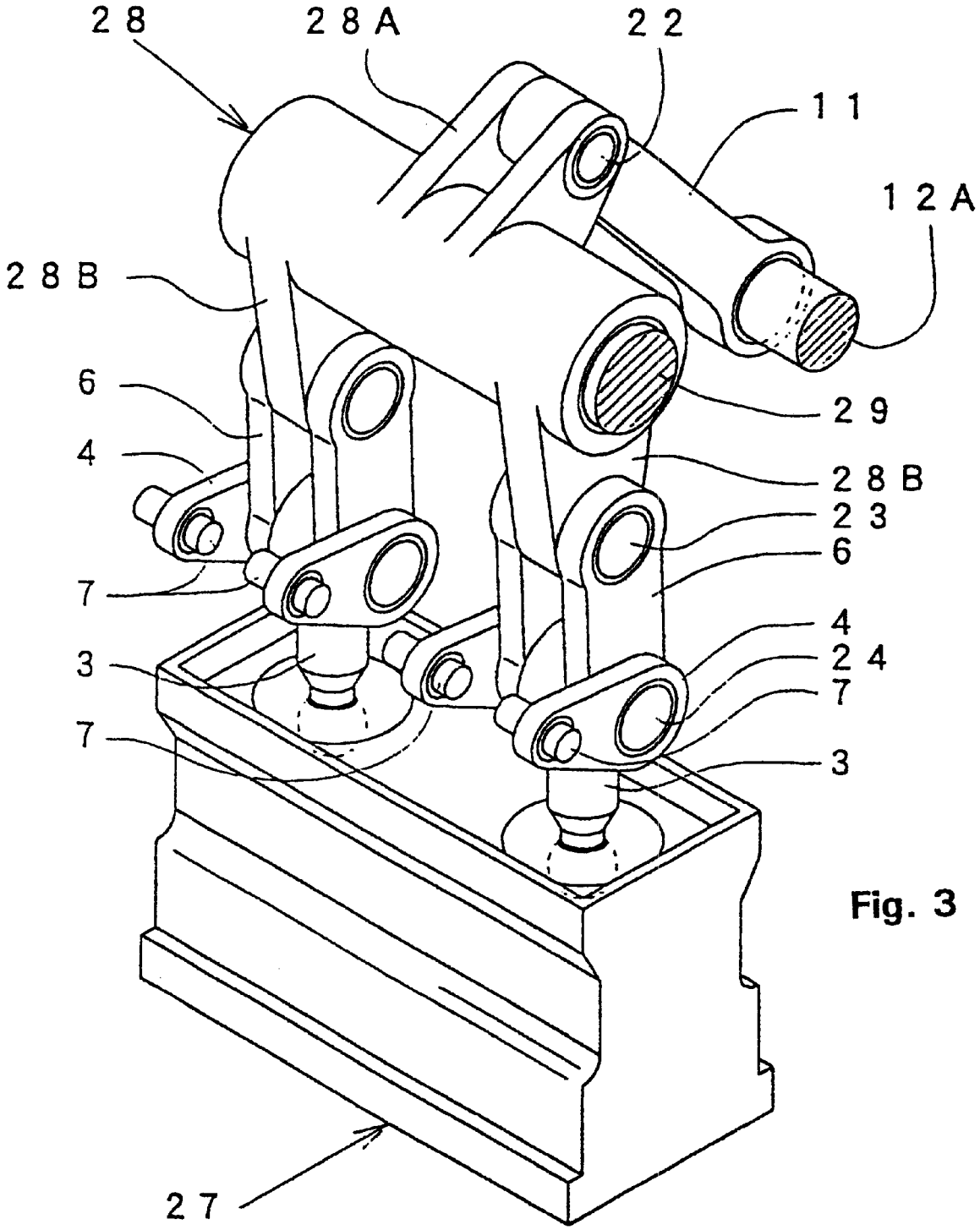
FIG. 3 is a perspective drawing of the slide-driving device employing a bell crank having double arms.

Referring now to FIG. 3, there is shown a slide-driving device according to a further embodiment of the present invention. The slide 27 is illustrated at the bottom dead center. In this structure, the one-point slide-driving device in the first embodiment described above is replaced by a two-point slide-driving device.

As in the previous embodiment, the eccentric section 12A of the crank shaft 12 (see FIGS. 1–2) is connected to the base end of a connecting rod 11.

A first support pin 29 is supported on an upper portion of the frame 1A (not shown in FIG. 3). The first support pin 29 is movably connected to a bell crank 28.

An upper end of the connecting rod 11 is fitted between double upper arms 28A, 28A of the bell crank 28. A first connecting pin 22 passes through aligned holes in the upper arms 28A, 28A and the connecting rod 11 to permit relative rotation therebetween. The ends of lower arms 28B, 28B of the bell crank 28, located below the first support pin 29, are connected to ends of the middle links 6, 6 by second connecting pins 23, 23.

Dual-base slide-adjusting devices 21, 21 (FIG. 4) are disposed on a slide 27 to adjust the die height. A pair of lower links 3, 3 include ball-shaped lower ends, are engaged in the slide 27. Upper ends of lower links 3, 3 project upward from the slide adjusting devices 21, 21 to provide a movable connection with the remainder of the apparatus shown in FIG. 3.

A bracket 9 (FIGS. 4 and 5) is fixed to a side of a lower portion of the frame 1A. The bracket 9 is movably connected to the bases of side links 4, 4 via second support pins 7, 7.

The end of side link 4 is connected via a third connecting pin 24 to both the lower end of the middle link 6 and the upper end of the lower link 3.

As in the embodiment of FIG. 1, with the slide-driving device having the structure described above, the slide 27, guided by a slide guide 20 (FIG. 4), is raised and lowered by a prescribed stroke length S.

The driving elements in the slide-driving device in FIG. 3 are the same as that described for FIG. 1. Thus the corresponding description will be omitted.

In the embodiment of FIG. 3, a pair of upper arms 28A are disposed above and between the lower arms at the lower portion of the bell crank 28. However, it is also possible to have a slide-driving device wherein a pair of spaced-apart upper arm 28A, 28A are generally aligned with the lower arms 28B, 28B, and to have the base thereof connected to the eccentric sections 12A, 12A of the crank shaft 12 via two connecting rods 11, 11.

The embodiment of FIG. 3 provides a two-point slide-driving device for improved stability. In addition to this and the one-point slide-driving device described in the prior embodiment, it is possible to have multi-point slide-driving devices which apply force through more than two linkages.

The embodiment of the invention shown in FIGS. 1B–3B may also be modified to a two-point slide-driving device in a manner similar to that shown in FIG. 3. In this embodiment, two bottom dead center compensating devices (not shown) are employed, either driven independently, or driven from the same power source. The operation of this modified embodiment is the same as previously described.

Figure 4:
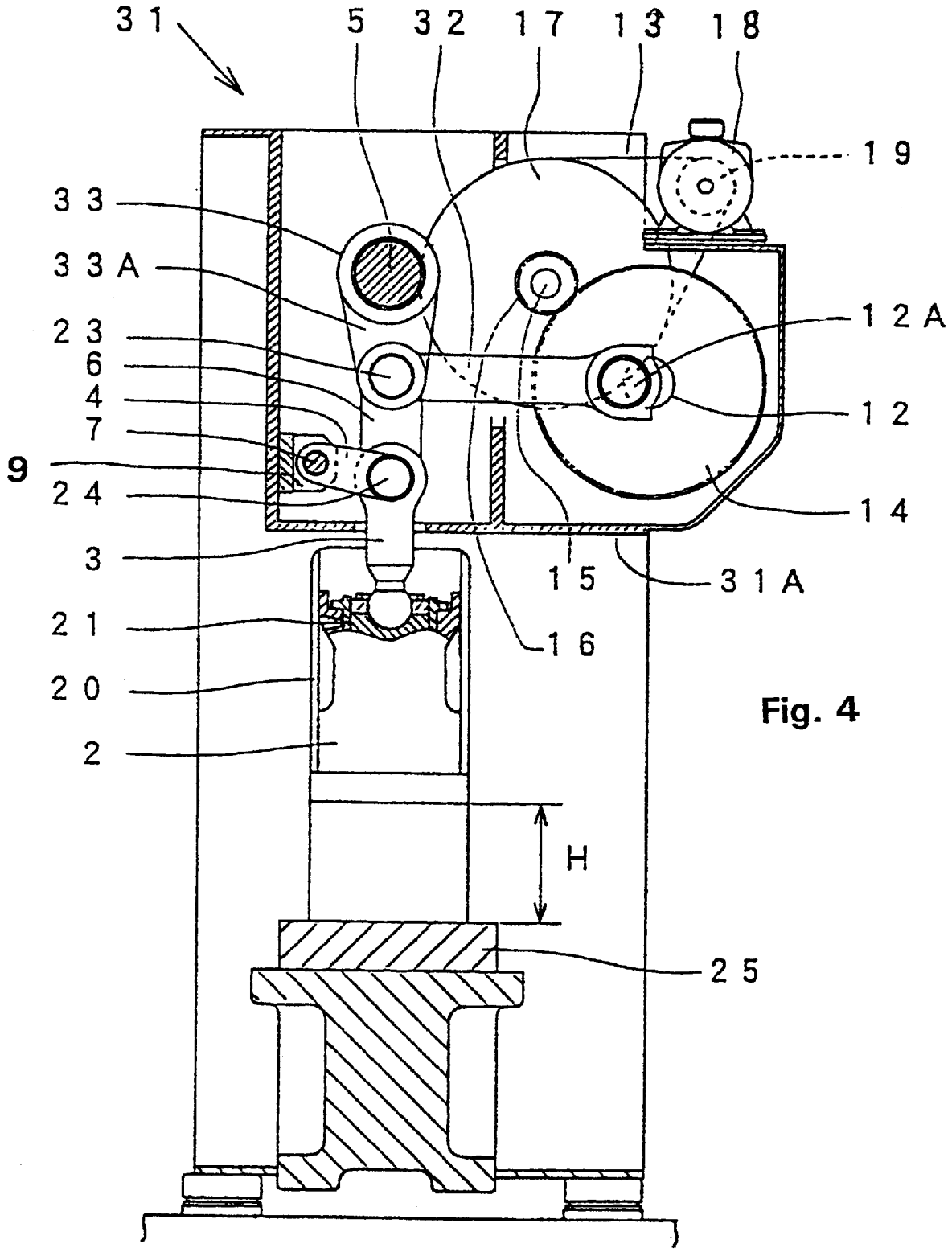
FIG. 4 is a schematic cross-section drawing of a knuckle press having a double link drive mechanism.

Referring to FIGS. 4 and 5, a further embodiment of a knuckle press 31 shown with its slide 2 at bottom dead center. In this embodiment the bell crank 8 of the embodiment shown in FIG. 1 is replaced by an upper link 33 which is movably connected to a first support pin 5. The base of the first support pin 5 is supported by a base 31A of the knuckle press 31. Also, an end of the upper link 33 is connected to an end of a connecting rod 32 and an end of the middle link 6 via a second connecting pin 23.

The structure of the crank shaft 12, which connects to the connecting rod 32, is essentially the same as in the prior embodiments described above up to the eccentric section 12A. Accordingly, that portion of the description of the operation is omitted.

The eccentric section 12A of the crank shaft 12, which is rotatably supported by the frame 31 A of the knuckle press 31, is connected to the base end of the connecting rod 32.

The upper link 33 connects the arm 33A of the upper link 33 below the first support pin 5 to an end of the connecting rod 11 and to an end of the middle link 6 via the second connecting pin 23.

A single-base slide adjusting device 21 is disposed on the slide 2 to adjust the die height H. The lower link 3, which has a ball-shaped lower end, projects upward from the slide adjusting device 21 to provide a movable connection.

At a lower portion of the frame 31 A, there is disposed the bracket 9, which is movably connected to the base end of the side link 4 via the second support pin 7.

The other end of the side link 4 is connected to the other end of the middle link 6 and to the other end of the lower link 3 via the third connecting pin 24.

With the slide-driving device described above, the slide 2 guided by the slide guide 20 is raised and lowered in a prescribed stroke length S.

Referring to FIG. 5, the slide 2 is shown at its extreme positions at the upper dead center (dash-dot line) and the bottom dead center (solid line). When the eccentric section 12A of the crank 12 is at its rightmost position, it moves the junction of the upper link 33 and the middle link 6 outward, thereby displacing the lower link 3, with the attached slide 2 to its top dead center position. When the eccentric section 12A is rotated to its leftmost position, this straightens out the connection between the upper link 33 and the middle link 6, thereby moving the slide 2 to its bottom dead center position. The total travel of the slide 2 between its two extremes is the prescribed stroke length S.

As a center O1 of the eccentric section 12A of the crank shaft 12 rotates along a path e, a center O5 of the second connecting pin 23, which connects the arm 33A of the upper link 33, moves along a path f. A center O4 of the third connecting pin 24, which connects the middle link 6 to the lower link 3 and the side link 4, moves along a path g.

As in the embodiment of FIG. 1, lower link 3 maintains a roughly perpendicular orientation while raising and lowering the slide 2. Thus, when the slide 2 is raised and lowered, a parallel orientation is maintained between the slide 2 and the bolster 25 (FIG. 4). This provides a significant reduction in the side-thrust forces acting on the slide guide 20, which guides the slide 2 when it is raised and lowered.

Also as in the embodiment of FIG. 1, during a single cycle of raising and lowering the slide 2, the maximum slope angle θ of the motion of the lower link 3 is limited to 3 degrees or less. This prevents scorching, rapid wear, and breakage of the slide guide 20 while also allowing high-precision molding of products even when using the press to form extrusions in which molding is begun with the slide 2 having a high bottom dead center.

The maximum slope angle θ of the lower link 3 can be reduced by making the lower link 3 longer. However, this would decrease the die height specification and require extra frame height to provide the die height. Thus, it is undesirable to make the arm of the side link 4 longer.

Figure 6:
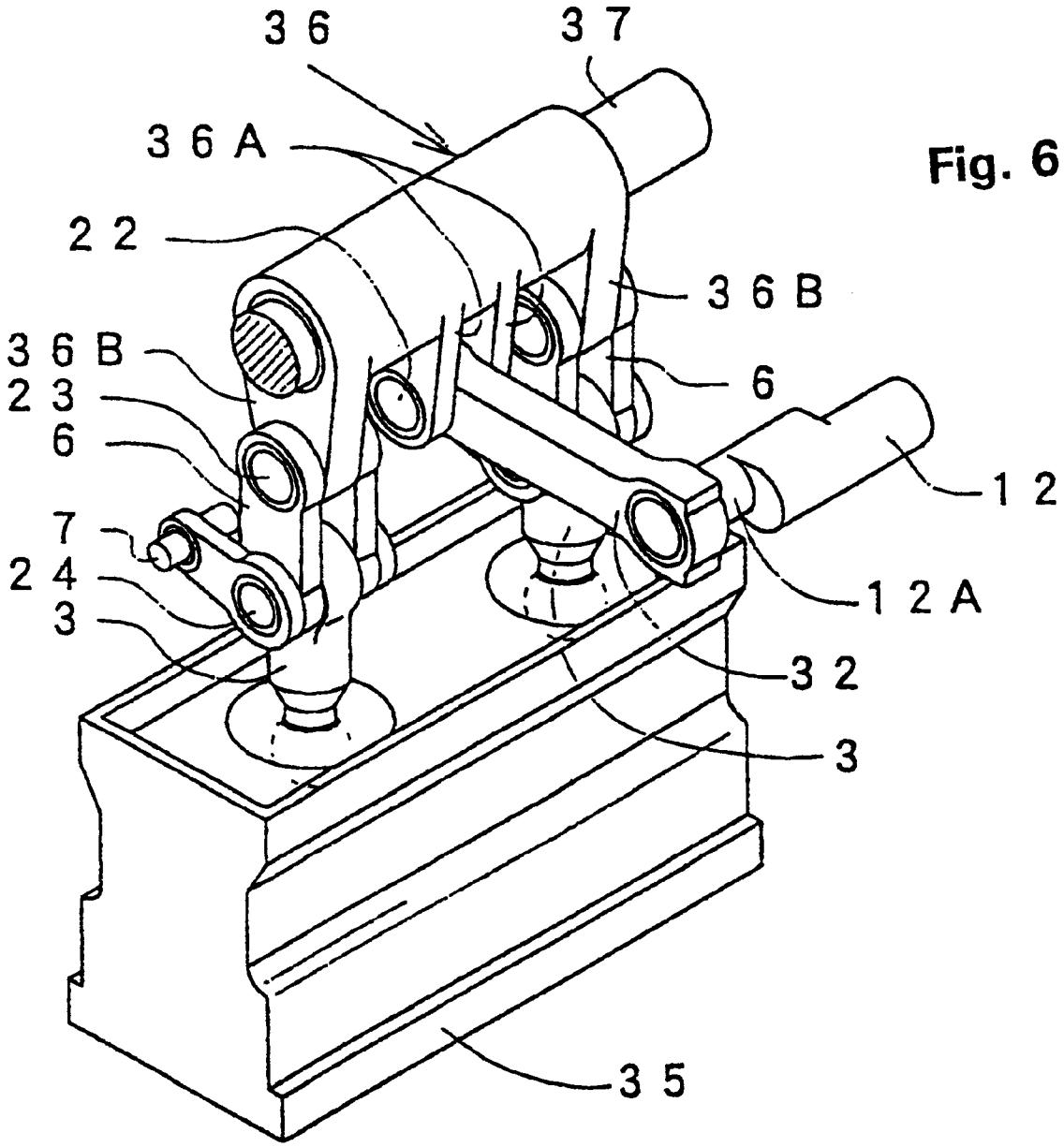
FIG. 6 is a perspective drawing of a slide-driving device in which the single double link device of FIG. 4 is replaced with a dual double link device for improved stability.

Referring to FIG. 6, there is shown a two-point slide-driving device. The slide 35 is shown at bottom dead center. Instead of the 1-point slide-driving device as in the embodiment of FIGS. 4 and 5, the embodiment of FIG. 6 discloses a 2-point slide-driving device.

The crank shaft 12 is rotatably supported on the frame (not shown). The driving linkage for rotating the crank shaft 12 is generally the same as in previous embodiments, thus illustration and description thereof is omitted.

The eccentric section 12A of the crank shaft 12 is connected to the base end of the connecting rod 32. A first support pin 37 is supported by the frame (not shown). The upper link 36 is movably connected to the first support pin 37.

An end of the first arm 36A of the upper link 36 below the first support pin 37 is connected to the end of the connecting rod 32 via the first connecting pin 22. The ends of the second arms 36B, 36B of the upper link 36 are connected to an end of the middle links 6, 6 via the second connecting pins 23, 23.

Two-base slide-adjusting devices are spaced apart on the slide 35. The two slide-adjusting devices are used for adjusting the die height. The lower links 3, 3, which have ball-shaped lower ends, project upward from the slide adjusting devices to provide a movable connection.

In the same manner as previous embodiments, side links 4, 4 are hinged on rigidly supported second support pins 7, 7.

The second end of each side link 4 is connected to both the other end of the middle link 6 and the other end of the lower link 3 via the third connecting pin 24.

With the slide-driving device described above, the slide 35, guided by the slide guide (not shown in the figure), is raised and lowered the prescribed stroke length S, as in the previous embodiments.

The operation of the structural elements in the slide-driving device of FIG. 6 is the same as that described for the embodiment of FIGS. 4 and 5, so the corresponding description will be omitted.

In the embodiment of FIG. 6, a two-point slide-driving device is disclosed. In addition to a two-point device, slide-driving devices employing more than two driving points are considered to be within the spirit and scope of the invention.

Figure 4B:
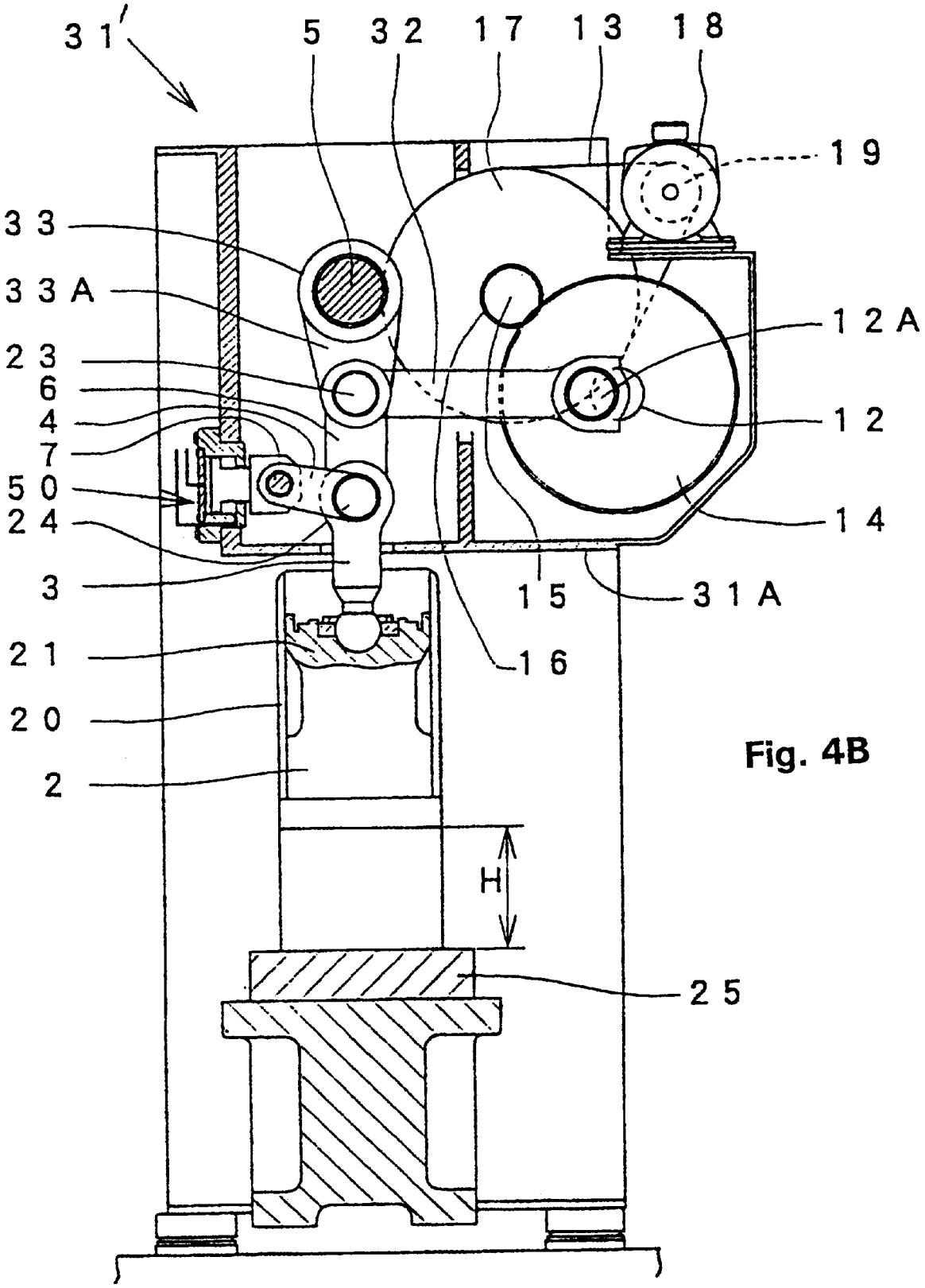
FIG. 4B is a schematic cross-section drawing of a knuckle press having a double link drive mechanism similar to that of FIG. 4, but with a linearly actuated bottom dead center compensation device.

Referring to FIGS. 4B and 5B, a knuckle press 31' includes a slide-driving device that is similar to the embodiment of FIG. 4, except for the addition of a bottom dead center compensating device 50. Description of this embodiment will thus be directed toward the bottom dead center compensating device 50. The description of the remainder of the knuckle press 31' is omitted.

The bottom dead center compensation device 50 for the slide is fixed to a lower portion of the frame 31A. Bottom dead center compensation device 50 is connected to move second support pin 7 in the horizontal direction. The bottom dead center compensation device 50 is movably connected via the second support pin 7 to the base end of the side link 4.

The end of the side link 4 is connected to the other end of the middle link 6 and the other end of the lower link 3 via the third connecting pin 24.

With the slide-driving device described above, the slide 2 guided by the slide guide 20 is raised and lowered by a prescribed stroke length (S).

Referring to FIG. 5B, the slide 2 is moved between its upper dead center (dash-dot lines) and its bottom dead center (solid lines) when the crank shaft (12) is rotated to raise and lower the slide 2 by the prescribed stroke length S. As a center O1 of the eccentric section 12A of the crank shaft 12 rotates along a path e, a center O5 of the second connecting pin 23, which connects the arm 33A of the upper link 33, moves along a path f. A center O4 of the third connecting pin 24, which connects the middle link 6 to the lower link 3 and the side link 4, moves along a path g.

As in the embodiment of FIG. 1B, lower link 3 maintains a roughly perpendicular orientation while raising and lowering the slide 2. Thus, when the slide 2 is raised and lowered, a roughly parallel orientation is maintained between the slide 2 and the bolster 25. This provides a significant reduction in the thrust force acting on the slide guide 20, which guides the slide 2 when it is raised and lowered.

Also as in the embodiment of FIG. 1B, during a single cycle of raising and lowering of the slide 2, the maximum sloping angle θ of the motion of the lower link 3 is kept small to prevent scorching, rapid wear, and breakage of the slide guide 20. This also allows high-precision molding of products even with extrusion, where molding is begun with the slide 2 having a high bottom dead center.

The maximum slope angle θ of the lower link 3 could be reduced by making the lower link 3 longer. However, this would decrease the die height specification and require extra frame height to provide the die height. Thus, it would be desirable to make the arm of the side link 4 longer.

Figure 6B:
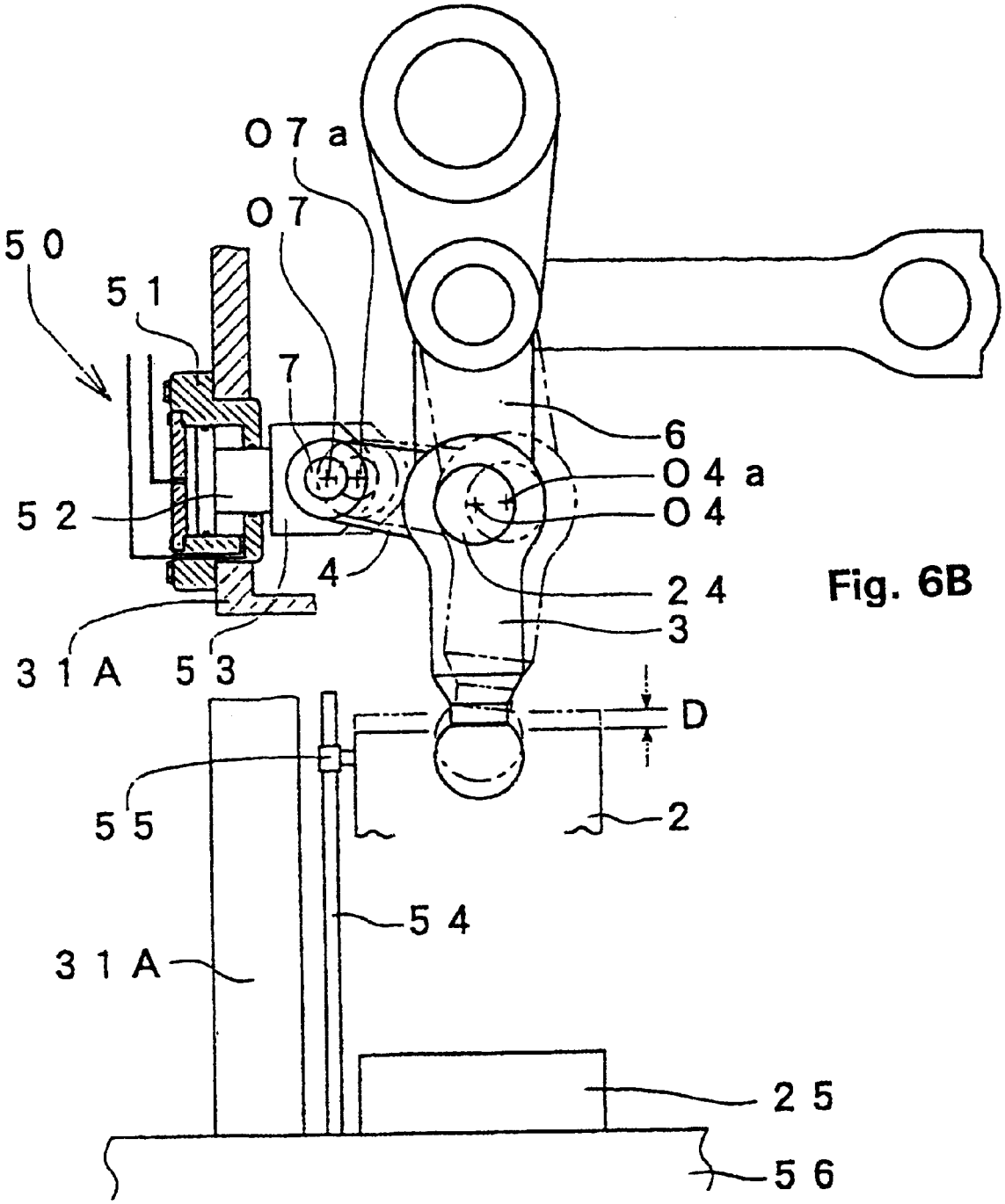
FIG. 6B is a schematic diagram elements of a servo drive for controlling the bottom dead center compensation device.

Referring to FIG. 6B, there is shown the state of the lower link 3, the side link 4, the middle link 6, and the slide 2 when the bottom dead center compensation device 50 of the slide is activated and a center O7 of the second support pin 7 moves to a center O7*a*. The location of the second support pin 7 before displacement is shown with solid lines and the state after displacement is shown with dotted lines.

The bottom dead center compensation device 50 of the slide includes a servo cylinder 51 directly attached to the frame 31A of the knuckle press 31. The servo cylinder 51 is connected to the second support pin 7 via a clevis 53 attached to the end of a rod 52 of the servo cylinder 51.

A linear encoder, which includes a scale 54 disposed on a bed 56 and a detector 55 attached to the slide 2, generates a slide position signal. Based on this signal, a signal from a servo control device (not shown in the figure) controls a servo valve so that the resulting fluid pressure displaces the rod 52 of the servo cylinder 51 a prescribed stroke distance. The center of the second support pin 7 is displaced between the point O7 and the point O7*a* in tandem with the active stroke distance of the servo cylinder 51. This displaces the center of the third connecting pin 24 of the lower link 3 and the middle link 6, which are connected to the side link 4, between the points O4 and O4*a*. The slide 2 moves up by amount D, providing fine compensation of the bottom dead center.

In this embodiment, the servo cylinder 51 is used as the drive source for the bottom dead center compensation device 50, but it is also possible to substitute other types of cylinders or drive devices.

Referring to FIG. 7B, an embodiment of the present invention is the same as the embodiment in FIG. 5, except for the addition of the bottom dead center compensation device 40. The operation of the knuckle press and the bottom dead center compensation device 40 is the same as that described in connection with prior figures. Thus further description of FIG. 7B is omitted herefrom.

Referring now to FIG. 8B, the bottom dead center compensation device 50 of FIG. 6B is substituted for the bottom dead center compensation device 40 of FIG. 7B. All other structures are identical with those of prior described embodiments, and the descriptions thereof will be omitted.

In the embodiments described above, the bottom dead center compensation devices 40, 50 displace the second support pin 7 horizontally. However, the direction of displacement is not restricted to the horizontal direction.

Also, in the foregoing embodiments two-point slide-driving devices may be substituted for the single-point slide-driving devices. However, where the bottom dead center compensating devices 40/50 are used, it is preferable to employ a pair of bottom dead center compensating devices, one in each linkage As the description above makes clear, the present invention: minimizes the sloping angle of the lower link, which raises and lowers the slide; prevents thrust force from being generated on the slide; and allows forming of high-precision products even with extrusion operations, where molding begins at a high bottom dead center position for the slide.

Also, scorching of the slide guide is prevented and the lifespan of the die is increased. The slide guide can be eliminated as well.

Furthermore, by using a slide adjustment device disposed on the point section of the slide together with a bottom dead center compensation device, fine compensation of the bottom dead center can be performed without stopping the knuckle press. Thus, product precision can be maintained in a stable manner to provide high-precision products.

The bottom dead center compensation devices 40, 50 may be adjusted either statically or dynamically. Static operation maintains the same horizontal position of the second support pin 7 throughout the stroke. This results in the travel of the center of the third connecting pin 24 in the arc d. Dynamic operation of the bottom dead center compensation devices 40, 50 performs cyclic adjustment during the stroke of the knuckle press to reduce or eliminate the curvature of the arc d. For this purpose, the servo type bottom dead center compensation device 50 is preferable because of its quicker response. With the arc d flattened, the slope angle θ remains constant near zero.

As is clear from the above description, the present invention provides a very small slope angle for the lower link, which raises and lowers the slide, and prevents thrust force from being generated on the slide while allowing molding of high-precision products even including extrusion, where molding begins from a high bottom dead center. Also, scorching of the slide guide is prevented and the lifespan of the die is extended. In some applications the slide guide may not be necessary, and thus may be eliminated.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A slide-driving device for knuckle presses comprising:

a first support pin;

said first support pin being affixed to a knuckle press frame;

a bell crank having a lower arm and an upper arm rotatably supported on said first support pin;

a drive train rotatably connected to said bell crank upper arm via a first connecting pin for rotating said bell crank about said first support pin;

a middle link having an upper end and a lower end movably connected at said middle link upper end to said bell crank lower arm via a second connecting pin;

a lower link having a bottom end and an upper end where said lower link bottom end is movably connected to a slide;

a side link having a base end and a connecting end where said side link connecting end is connected to both said middle link lower end and said lower link upper end via a third connecting pin; and said side link base end is movably connected, via a second support pin, to a member disposed on said knuckle press frame.

2. A slide-driving device according to claim 1, wherein said member disposed on said frame is immovably affixed to said knuckle press frame.

3. A slide-driving device for knuckle presses as recited in claim 1 wherein said connecting end of said side link is positioned to maintain a maximum slope angle between said lower link and a perpendicular line from said bottom end of said lower link of no more than 3 degrees during a cycle of raising and lowering of said slide.

4. A slide-driving device for knuckle presses comprising:

a first support pin, said first support pin being affixed to a knuckle press frame;

a bell crank having a lower arm and an upper arm rotatably supported on said first support pin;

a drive train rotatable connected to said bell crank upper arm via a first connecting pin for rotating said bell crank about said first support pin;

a middle link having an upper end and a lower end movably connected at said middle link upper end to said bell crank lower arm via a second connecting pin;

a lower link having a bottom end and an upper end where said lower link bottom end is movably connected to a slide;

a side link having a base end and a connecting end where said side link connecting end is connected to both said middle link lower end and said lower link upper end via a third connecting pin; and said side link base end is movably connected, via a second support pin, to a member disposed on said knuckle press frame;

said member having a bottom dead center compensation device;

an actuator in said bottom dead center compensation device;

said actuator being connected to move said second support pin in a direction, and in an amount to adjust a bottom dead center position of said bottom end.

5. A slide-driving device according to claim 4, wherein said actuator includes a servo.

6. A slide-driving device according to claim 4, wherein said actuator includes a feedback device for controlling a position of said second support pin.

7. A slide-driving device according to claim 4, wherein said direction is generally horizontal.

8. A slide-driving device for knuckle presses comprising:

a first support pin rigidly affixed to a knuckle press frame;

an upper link having an upper end and a lower end;

said upper link upper end rotatably supported on said first support pin;

a middle link having an upper end and a lower end;

said middle link upper end pivotally connected with a first connecting pin at a first junction with said upper link lower end;

a connecting rod having a connecting end and a drive train end;

said connecting rod connecting end pivotally connected with said first connecting pin at said first junction;

a drive train rotatably connected to said connecting rod drive train end for displacing said connecting rod toward and away from said first junction;

a lower link having an upper end and a bottom end;

said upper end of said lower link is pivotally connected with a second connecting pin at a second junction with said lower end of said middle link;

said bottom end of said lower link being movably connected to a slide;

a side link having a base end and a connecting end;

said side link connecting end is pivotally connected with said second connecting pin at said second junction; and said base end of said side link is pivotally connected with a second support pin to a member disposed on said knuckle press frame.

9. A slide-driving device according to claim 8, wherein said member disposed on said frame is immovably affixed to said knuckle press frame.

10. A slide-driving device according to claim 8, wherein said member disposed on said knuckle press frame includes:

a bottom dead center compensation device;

an actuator in said bottom dead center compensation device;

said actuator being connected to move said second support pin in a direction, and in an amount to adjust a bottom dead center position of said bottom end of said lower link.

11. A slide-driving device according to claim 9, wherein said actuator includes a feedback device for controlling a position of said second support pin.

12. A slide-driving device according to claim 9, wherein said direction is generally horizontal.

13. A slide-driving device according to claim 10, wherein said actuator includes a servo.

14. A slide-driving device for knuckle presses as recited in claim 7 wherein said connecting end of said side link is positioned to maintain a maximum slope angle between said lower link and a perpendicular line from said bottom end of said lower link of no more than 3 degrees during a cycle of raising and lowering of said slide.

15. A slide-driving device for knuckle presses comprising:

a first support pin;

said first support pin being affixed to a knuckle press frame;

a bell crank having a lower arm and an upper arm rotatably supported on said first support pin;

a drive train rotatably connected to said bell crank upper arm via a first connecting pin for rotating said bell crank about said first support pin;

a middle link having an upper end and a lower end movably connected at said middle link upper end to said bell crank lower arm via a second connecting pin;

a lower link having a bottom end and an upper end where said lower link bottom end is movably connected to a bottom dead center compensation device;

said bottom dead center compensation device is movably connected to a slide;

a side link having a base end and a connecting end where said side link connecting end is connected to both said middle link lower end and said lower link upper end via a third connecting pin; and said side link base end is movably connected, via a second support pin, to a member disposed on said knuckle press frame.

16. A slide-driving device for knuckle presses as recited in claim 15 wherein said bottom dead center compensation device includes a slide height adjustment device.

17. A slide-driving device for knuckle presses as recited in claim 15 wherein a means is provided for permitting movement of said member with respect to said knuckle press frame.

* * * * *